US009045952B2

(12) United States Patent
Sonnier

(10) Patent No.: US 9,045,952 B2
(45) Date of Patent: Jun. 2, 2015

(54) TUBULAR COMPENSATOR SYSTEM AND METHOD

(75) Inventor: Errol Anthony Sonnier, Broussard, LA (US)

(73) Assignee: TESCO CORPORATION, Houston, TX (US)

( * ) Notice: Subject to any disclaimer, the term of this patent is extended or adjusted under 35 U.S.C. 154(b) by 670 days.

(21) Appl. No.: 13/314,923

(22) Filed: Dec. 8, 2011

(65) Prior Publication Data

US 2013/0146304 A1 Jun. 13, 2013

(51) Int. Cl.
*E21B 19/06* (2006.01)
*E21B 19/16* (2006.01)

(52) U.S. Cl.
CPC ..... *E21B 19/06* (2013.01); *E21B 19/16* (2013.01)

(58) Field of Classification Search
CPC ..... E21B 19/06; E21B 19/16
USPC ..... 166/379, 380, 77.51, 77.52; 175/85
See application file for complete search history.

(56) References Cited

U.S. PATENT DOCUMENTS 6,000,472 A * 12/1999 Albright et al. ..... 166/380
6,056,060 A 5/2000 Abrahamsen et al.
7,350,586 B2 * 4/2008 Guidry ..... 166/380
7,984,757 B1 7/2011 Keast et al.
8,191,621 B2 * 6/2012 Sweeney et al. ..... 166/77.52
8,662,178 B2 * 3/2014 Norrid et al. ..... 166/318
2003/0000708 A1 * 1/2003 Coone ..... 166/379
2007/0158076 A1 7/2007 Hollingsworth, Jr. et al.

FOREIGN PATENT DOCUMENTS

WO 9934088 7/1999
WO 9945230 9/1999
WO 9958810 11/1999

OTHER PUBLICATIONS

"Invitation to Pay Additional Fees and, Where Applicable, Protest Fee," International Searching Authority, Jun. 3, 2013, pp. 1-5.

* cited by examiner

*Primary Examiner* — Robert E Fuller
(74) *Attorney, Agent, or Firm* — Fletcher Yoder, P.C.

(57) ABSTRACT

A stand compensator system, wherein the stand compensator system includes gripping device configured to engage a tubular element by coupling about an outer circumference of the tubular element. Additionally, the tubular compensator system includes a plurality of resilient roller assemblies positioned proximate an inner perimeter of the gripping device, wherein the resilient roller assemblies include rollers arranged to engage with an abutting surface of the tubular element. Further, the stand compensator system includes engagement arms coupled with the gripping device, wherein the engagement arms are configured to hold the gripping device in position above a tubular elevator and couple between rig bails extending from the tubular elevator.

19 Claims, 5 Drawing Sheets

TUBULAR COMPENSATOR SYSTEM AND METHOD

BACKGROUND

Present embodiments relate generally to the field of drilling and processing of wells, and, more particularly, to tubular compensators.

In conventional oil and gas operations, a drilling rig is used to drill a wellbore to a desired depth using a drill string, which includes drillpipe, drill collars and a bottom hole drilling assembly. During drilling, the drill string may be turned by a rotary table and kelly assembly or by a top drive. Once the wellbore reaches total depth, the drill string may be removed from the well and the completion phase may be initiated. The completion phase includes assembling downhole tubulars and equipment used to enable production from an oil or gas well.

During completion of the well, the drilling rig may be used to insert joints or stands (e.g., multiple coupled joints) of tubular into the wellbore that will be used for production. Similarly, the drilling rig may be used to remove tubular from the wellbore. As an example, during insertion of tubular into the wellbore by a traditional operation, each tubular element (e.g., each joint or stand) is coupled to an attachment feature that is in turn lifted by a traveling block of the drilling rig such that the tubular element is positioned over the wellbore. An initial tubular element may be positioned in the wellbore and held in place by gripping devices near the rig floor, such as slips. Subsequent tubular elements may then be coupled to the existing tubular elements in the wellbore to continue formation of the completion string. Once attached, the tubular element and remaining completion string may be held in place by an elevator and released from the gripping devices (e.g., slips) such that the completion string can be lowered into the wellbore. Once the completion string is in place, the gripping devices can be reengaged to hold the completion string such that the elevator can be released and the process of attaching tubular elements can be started again.

Assembly of tubular in a completion string can result in damage to tubular elements. Indeed, due to the weight of tubular elements, damage can occur when engaging mating ends of tubular elements already disposed within the wellbore and those being added to the completion string. Traditionally, tubular compensators have been utilized to offset the weight of tubular elements being added and thus reduce the occurrence of such damage. However, it is now recognized that some existing tubular compensators can be cumbersome, consume excessive vertical space, and function inefficiently. Accordingly, it is now recognized that there exists a need for an improved tubular compensator.

BRIEF DESCRIPTION

In accordance with one aspect of the invention, a stand compensator system is provided. The system includes a gripping device configured to engage a tubular element by coupling about an outer circumference of the tubular element. Further, the system includes a plurality of resilient roller assemblies positioned proximate an inner perimeter of the gripping device, wherein the resilient roller assemblies include rollers arranged to engage with an abutting surface of the tubular element. Additionally, the system includes engagement arms coupled with the gripping device, wherein the engagement arms are configured to hold the gripping device in position above a tubular elevator and couple between rig bails extending from the tubular elevator.

In accordance with one aspect of the invention, a stand compensator system is provided that includes a tubular elevator, a first rig bail, and a second rig bail, wherein each of the first and second rig bails is coupled to the tubular elevator and extends upward from the tubular elevator. Further, the system includes a gripping device positioned between the first rig bail and the second rig bail, wherein the gripping device is configured to engage a tubular element by coupling about an outer circumference of the tubular element. Additionally, the system includes a first engagement arm coupled to the first rig bail and coupled to the gripping device, a second engagement arm coupled to the second rig bail and coupled to the gripping device, and a first actuator configured to reposition the first engagement arm.

In accordance with one aspect of the invention, a method for assembling tubular elements is provided. The method includes receiving a tubular element into a gripping device, wherein the gripping device includes a first portion and a second portion, closing the gripping device about the tubular element by moving at least one engagement arm such that one end of the engagement arm is repositioned away from a rig bail to which the engagement arm is coupled and such that the first portion of the gripping device, which is also coupled to the engagement arm engages with the second portion of the engagement device about the tubular element, engaging a surface of the tubular element with rollers of a plurality of roller assemblies integrated with the gripping device, and facilitating attachment of the tubular element to another tubular element.

DRAWINGS

These and other features, aspects, and advantages of the present invention will become better understood when the following detailed description is read with reference to the accompanying drawings in which like characters represent like parts throughout the drawings, wherein.

DETAILED DESCRIPTION

Figure 1:
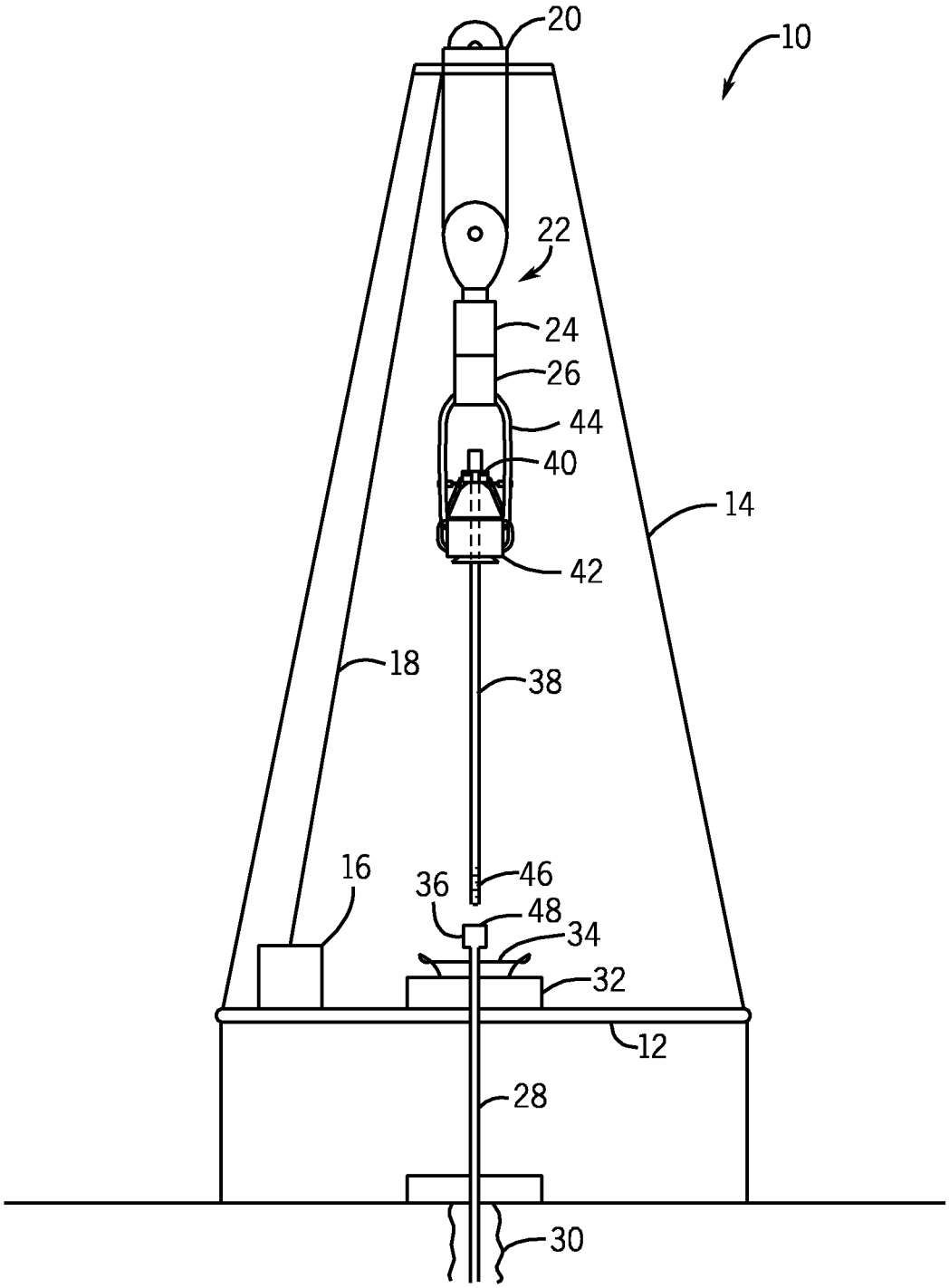
FIG. 1 is a schematic of a well being completed in accordance with present techniques.

Embodiments of the present disclosure are directed to tubular compensator systems and related methods. In accordance with present embodiments, a tubular or stand compensator system generally functions to couple with tubular elements and facilitate control while stabbing the tubular elements into and coupling with other tubular elements to form a tubular string.

Each tubular element typically includes a pin end and a box end to facilitate coupling of multiple joints of tubular. When positioning and assembling tubular elements in the wellbore, a tubular element is typically inserted into the wellbore until only an upper end is exposed above the wellbore. At this point, a gripping member positioned near the rig floor holds the tubular element in place. The box end is typically positioned uphole such that the pin end of subsequently inserted tubular can be coupled with the box end of the previously inserted tubular to form the downhole string. In traditional operations, positioning the pin end of a tubular element relative to the box end of another tubular element to facilitate coupling can result in damage to the tubular elements. For example, due to the weight of the tubular elements (especially stands of multiple tubular joints), the threads of the pin and box ends can be damaged during engagement. In accordance with present embodiments, tubular compensators resiliently support the weight of the tubular element being lowered and coupled with the tubular string in the wellbore to limit axial load transfer and reduce the potential for damage to threads. Also, present embodiments assist in make up of tubular threads with rollers that may simply facilitate make up or actually impart motion.

In present embodiments, to add a length of tubular to the completion string, a tubular compensator holds the length of tubular and is utilized to offset the weight of the length of tubular. Indeed, a tubular compensator in accordance with present embodiments may include a gripping device configured to engage the tubular element by coupling about an outer circumference of the tubular element. Further, the tubular compensator may include a plurality of resilient roller assemblies positioned proximate an inner perimeter of the gripping device. These resilient roller assemblies adjust and compensate (e.g., vertically or horizontally) for the weight of the tubular element to prevent damage to threads on the pin end or box end of the tubular being connected. For example, the resilient roller assemblies include rollers arranged to engage with an abutting surface of the tubular element such that rotational movement of the tubular element is facilitated by the rollers and such that the resilient roller assemblies vertically adjust based on force applied by the tubular element. Indeed, the resilient roller assemblies may include pressure-controlled pistons that move vertically to adjust for the weight or force applied by the tubular element. Otherwise, if the full weight of a stand of tubular being added to the completion string is placed on the threads of the box end of the uppermost tubular in the completion string, it is likely that damage (e.g., thread damage) will occur. This is especially true when multiple joints are included in the length of tubular being added and for certain types of tubular (e.g., tubular including chrome and certain steels).

In modern ultra deepwater drilling operations, multiple rotaries are often utilized to make up completion tubulars offline. A pipe racking system then transports these stands to the main rotary for running into the wellbore. It is now recognized that traditional compensators utilized with pipe racking systems are not designed for handling certain tubulars (e.g., chrome tubular). Indeed, corrosion resistant alloy tubulars, such as chrome tubulars, are extremely susceptible to galling and damage during stabbing and make up to other tubulars. Accordingly, present embodiments are directed to providing more control while stabbing a tubular element into another tubular element, counterbalancing during make up of the coupling between the tubular elements to reduce load on the threads, and facilitating the entire process by reducing or eliminating the need for use of manual tongs during the initial make up of the coupling between the tubular elements. Additionally, due to limited vertical space for attachment of stands including multiple joints of tubular and so forth, present embodiments conserve vertical space by positioning the gripping device over a tubular elevator. This is achieved by including engagement arms coupled with the gripping device, wherein the engagement arms are coupled between rig bails extending from the tubular elevator. The engagement arms are configured to hold the gripping device in position above the tubular elevator and may be positioned for engagement by one or more actuator arms that are also coupled between the rig bails.

Turning now to the drawings, FIG. 1 is a schematic of a drilling rig 10 in the process of completing a well in accordance with present techniques. The drilling rig 10 features an elevated rig floor 12 and a derrick 14 extending above the rig floor 12. A supply reel 16 supplies drilling line 18 to a crown block 20 and traveling block 22 configured to hoist various types of equipment and tubular above the rig floor 12. The drilling line 18 is secured to a deadline tiedown anchor 24, and a drawworks 26 regulates the amount of drilling line 18 in use and, consequently, the height of the traveling block 22 at a given moment. Below the rig floor 12, a completion string 28 extends downward into a wellbore or riser 30 and is held stationary with respect to the rig floor 12 by a rotary table 32 and slips 34. A portion of the completion string 28 extends above the rig floor 12, forming a stump 36 to which another tubular element or length of tubular 38 may be added. The length of tubular 38 is held in place by a tubular compensator 40 coupled with an elevator 42 in accordance with present embodiments. The elevator 42 includes rig bails 44 that couple with the traveling block 22. It should be noted that the length of tubular 38, which may include a stand of multiple tubular joints, may be supplied to the tubular compensator 40 by a pipe racking system that is not shown.

In the illustrated embodiment, the length of tubular 38 is being held by the tubular compensator 40, which has been hoisted by the traveling block 22 to position the tubular element 38 above the wellbore before coupling with the tubular or completion string 28. This alignment allows the tubular element 38 to be stabbed into the completion string 28 by lowering a pin end 46 of the tubular element 38 into engagement with a box end 48 of the completion string 28. Once the pin end 46 of the tubular element 38 is stabbed into the box end 48 of the completion string 28, the tubular element 38 may be rotated to make up the threaded elements of the pin end 46 and box end 48 and couple the tubular element 38 into the completion string. It should be noted that power tongs (e.g., hydraulic power tongs) may be utilized to rotate the tubular element 38. Further, while the power tongs may ultimately bring the tubular completion string to full torque, features of the tubular compensator 40 may also be utilized to facilitate rotation of the tubular element 38 such that it connects with the stump 36 and becomes part of the completion string 28. Indeed, as will be discussed below, the tubular compensator 40 may include resilient roller assemblies that engage a surface of the tubular element 38 and facilitate rotational movement by providing less resistance to such movement or by imparting such movement. In other embodiments, the tubular compensator 40 may simply include rollers (e.g., ball bearings or cylinders).

After the tubular element 38 has been coupled with and incorporated into the completion string 28, it may be desirable to maneuver the completion string further into the riser 30 to facilitate attachment of another tubular element and continue to expand the length of the completion string 28. This will require releasing the completion string 28 for lowering further into the riser 30. However, the tubular compensator 40 may not be configured to support the weight of the entire completion string 28. Accordingly, support of the completion string 28 may be transferred to the elevator 42 from the tubular compensator 40. Indeed, as an example, the tubular compensator 40 may be designed to hold approximately 3,000 pounds while the elevator 40 may be designed to hold 500 tons. Accordingly, the elevator 42 may be activated to engage the tubular element 38. Once engagement between the elevator 42 and the tubular element 38 and thus the completion string 28 is confirmed, the tubular compensator 40 is released from engagement with the tubular element 38.

After the elevator 42 is engaged with the tubular element 38 and thus the completion string 28, the slips 34 are removed such that the force of the weight of the completion string 28 is transferred to the elevator 42 from the slips 34. At this point, the completion string 28 is lowered into the wellbore by the rig 10. Once the desired positioning of the completion string 28 is achieved and the upper portion of the tubular element 38 is extending above the rig floor 12 to form another stump to which further tubular elements may be added, the slips 34 may be repositioned to hold the completion string 28 in place. With the slips 34 back in place and holding the completion string 28, the elevator 42 may release its engagement with the completion string 28. Likewise, if the tubular compensator 40 is still coupled with the completion string 28, the tubular compensator 40 may also release its engagement. Thus, the tubular element 40 can be positioned to receive another tubular element from a pipe racking system or the like to continue extending the completion string 28.

Figure 2:
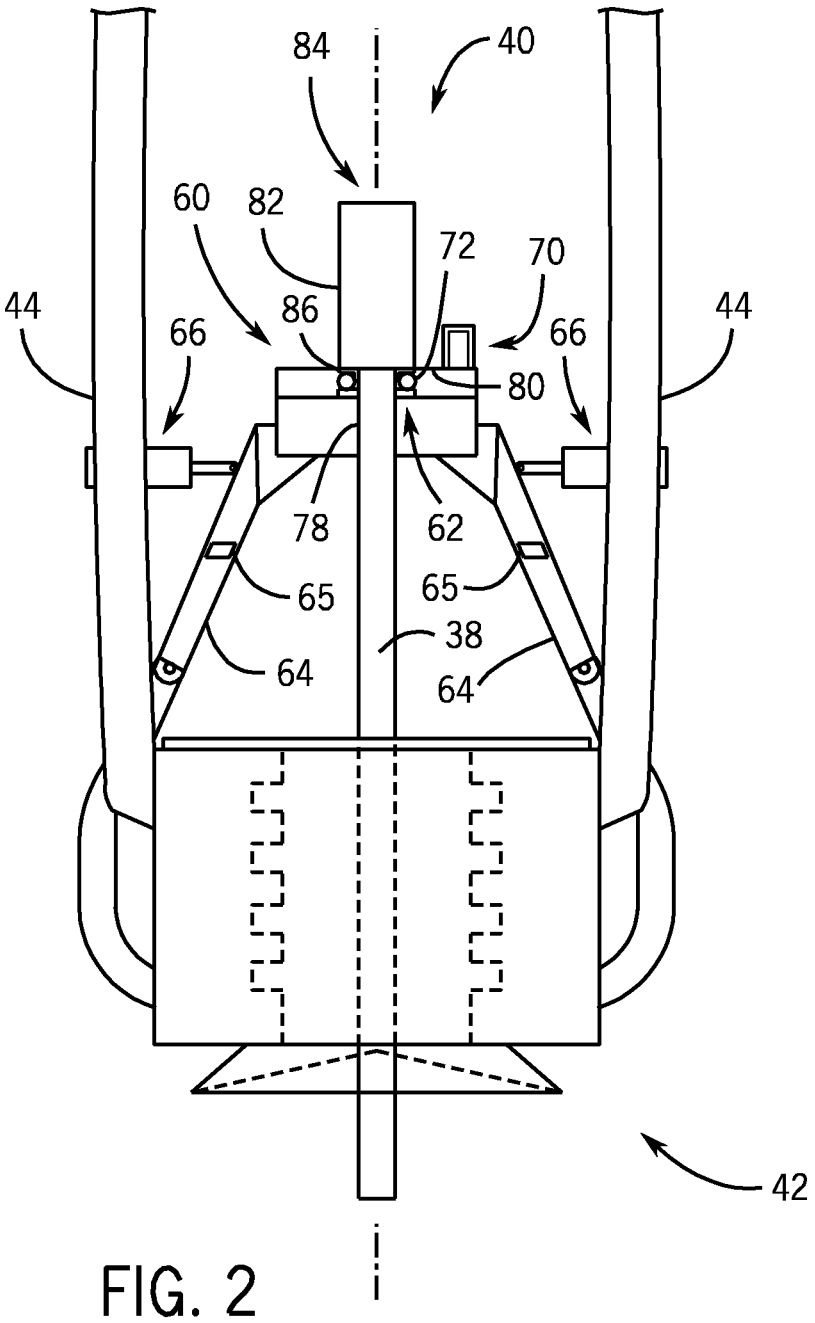
FIG. 2 is a schematic cross-sectional view of a tubular compensator attached to an elevator in accordance with present techniques.

FIG. 2 is a schematic cross-sectional view of the tubular compensator 40 and the elevator 42 in accordance with present embodiments. The elevator 42 may include a slip grip or casing bushing type elevator. In the illustrated embodiment, the tubular compensator 40 is assembled with the elevator 42 such that the tubular compensator is positioned above the elevator 42 and between the rig bails 44. This conserves vertical space in the rig 10 relative to traditional stand compensators that are positioned beneath the elevator 42. In the illustrated embodiment, the tubular compensator 40 includes a gripping device 60, a plurality of resilient rolling assemblies 62 that are integral with or attached to the gripping device 60, engagement arms 64 that are coupled with the gripping device 60 between the rig bails 44, and a pair of actuator arms 66 configured to maneuver the gripping device 60 and the engagement arms 64. Additionally, in the illustrated embodiment, the tubular compensator 40 includes a motor 70 (e.g., an air-operated and bi-directional motor) configured to spin rollers 72 of the resilient rolling assemblies 62 to impart rotational force to the tubular element 38 in a clockwise or counterclockwise direction.

In the stage of operation illustrated by FIG. 2, the gripping device 60 is disposed or positioned about the tubular element 38. In this arrangement, an interior wall 78 of the gripping device 60 may be engaged with an outer circumference of the tubular element 38. In some embodiments, the interior wall 78 may include rollers extending inward. For example, components of the resilient rolling assemblies 62 may form part of the interior wall 78. Further, an upper surface 80 of the gripping device 60 is generally engaged with the tubular element 38. Indeed, the upper portion of the tubular element 38 includes a coupled bushing or tool joint 82, which is essentially an outer portion of a box end 84 of the tubular element 38. Specifically, a lip 86 of the tool joint 82 is adjacent the upper surface 80 of the gripping device 60. This abutment of the tool joint 82 and the gripping device 60 assists in holding the tubular element 38 vertically in place.

It should be noted that the rollers 72 of the resilient roller assemblies 62 may engage the lip 86 of the tool joint 82 through the upper surface 80 of the gripping device 60, engage the outer circumference of the tubular element 38 through the interior wall 78 of the gripping device 60, or both. Thus, the rollers 60 may facilitate rotation of the tubular element 38 about its axis by providing reduced friction or by imparting rotation. Indeed, the rollers 60 (e.g., roller balls or cylindrical rollers) may be directed to spin by the motor 70 such that rotational force is applied from the motor 70 to the tubular element 38 via the rollers 60. This may assist in initiating make up of the tubular element 38 to the completion string 28, which may reduce or eliminate the need for manual tongs during initial make up. Additionally, engagement of the resilient roller assemblies 62 with the tubular element 38 assists with compensation of force applied by the tubular element 38 (e.g., downward force applied to another tubular element to which the tubular element 38 is being coupled or stabbed into) because the resilient roller assemblies 62 include air-operated pistons that are pressure-controlled. In other embodiments, different types of resilient features may be employed. For example, pressure-controlled cylinders 65 may be included in the engagement arms 64 and separate rollers may be employed along the interior or face of the gripping device 60.

Coupling of the gripping device 60 about the tubular element 38, as illustrated in FIG. 2, may be achieved by activation of the engagement arms 64 such that sides of the gripping device 60 are pushed together around the tubular element 38. When disengaged, the sides of the gripping device 60 may be positioned nearer the rig bails 44 such that the tubular 38 is freed to move vertically between the components of the gripping device 60. In some embodiments, the engagement arms 64 may be self-actuated and arranged at various angles with respect to the gripping device 60. In the illustrated embodiment, actuation arms 66 are configured to actuate the engagement arms 64. Bottom ends of the engagement arms 64 are hingedly coupled with the rig bails 44 near a base of the rig bails 44 such that the engagement arms 64 can rotate into a position that provides substantial vertical support along the length of the engagement arms 64. Further, in the illustrated embodiment, the engagement arms are coupled with the actuation arms 66 that extend from the rig bails 44 essentially horizontally. Both the engagement arms 64 and the actuation arms 66 are coupled with and positioned between the rig bails 44. The actuation arms 66 may include hydraulic actuators or the like that extend or retract into or away from a central area between the rig bails 44 such that they either push upper ends of the engagement arms 64 toward one another or pull the upper ends of the engagement arms 64 away from one another. This motion is translated to the components of the gripping device 60 to facilitate engagement and disengagement with the tubular element 38. It should be noted that, in some embodiments, one of the engagement arms 66 may remain fixed while the other engagement arm 66 is moved to cause engagement or disengagement of the gripping device 60 with the tubular element 38. Additionally, in other embodiments, different actuation features and relationships may be employed. For example, the gripping device 60 may be hinged such that the engagement arms 64 function to open and close the gripping device about a hinge.

Figure 3:
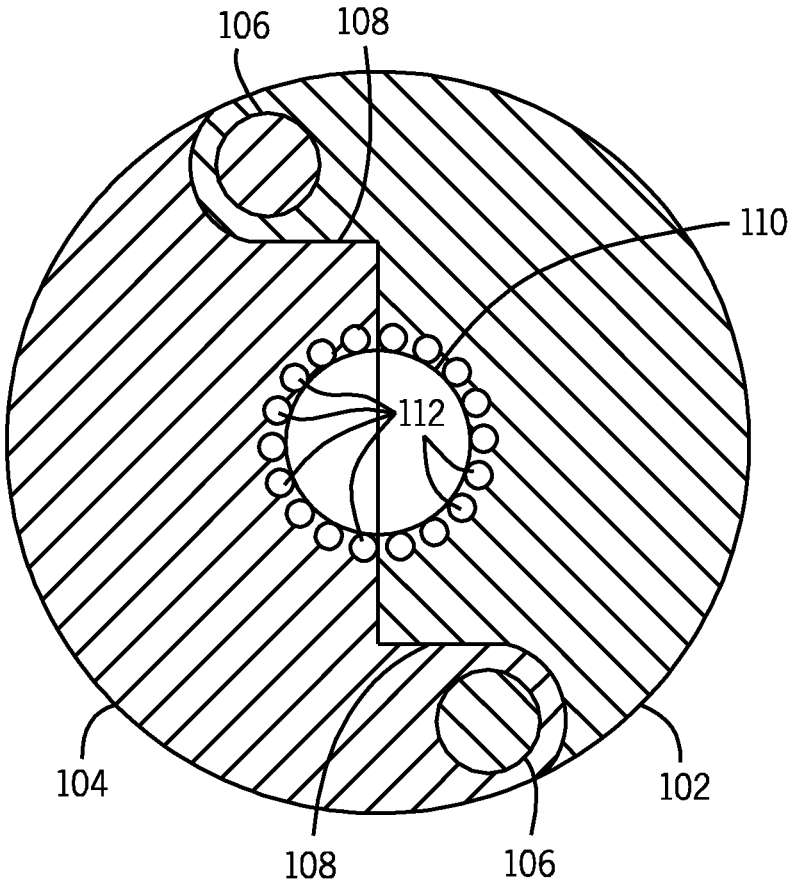
FIG. 3 is a schematic cross-sectional view of a tubular coupling feature of the tubular compensator illustrated in FIG. 2 in accordance with present techniques.

FIG. 3 is a schematic cross-sectional view of the gripping device 60 of the tubular compensator 40 in accordance with present embodiments. In the illustrated embodiment, the gripping device 60 includes a first body component 102, a second body component 104, pins 106 that function as coupling features with overlapping extensions 108 of the first body component 102 and second body component 104, an interior perimeter 110, and a plurality of resilient roller assemblies 112 positioned proximate the interior perimeter 110. The first body component 102 and the second body component 104 are coupled together via the pins 106. While other coupling features may be utilized, in the illustrated embodiment, the pins 106 slide through overlapping extensions 108 of the first body component 102 and the second body component 104 such that the pins 106 hold the gripping device 60 together as a unit when engaged. The pins 106 may be activated by or integral with actuators that automatically engage or disengage the pins 106 with openings in the overlapping extensions 108 depending on whether the gripping device 60 is being coupled or decoupled from a tubular element 38 or the like. In some embodiments, one of the pins 106 may represent a fixed hinge mechanism and the other pin 106 may represent a locking mechanism such that the gripping device 60 can be opened by disengaging the locking mechanism and rotating about the hinge. Thus, a tubular can be placed in the opening, and the gripping mechanism can be closed about the tubular. Further, in other embodiments, the gripping device 60 may include more than two body components and different types of coupling features.

Figure 4:
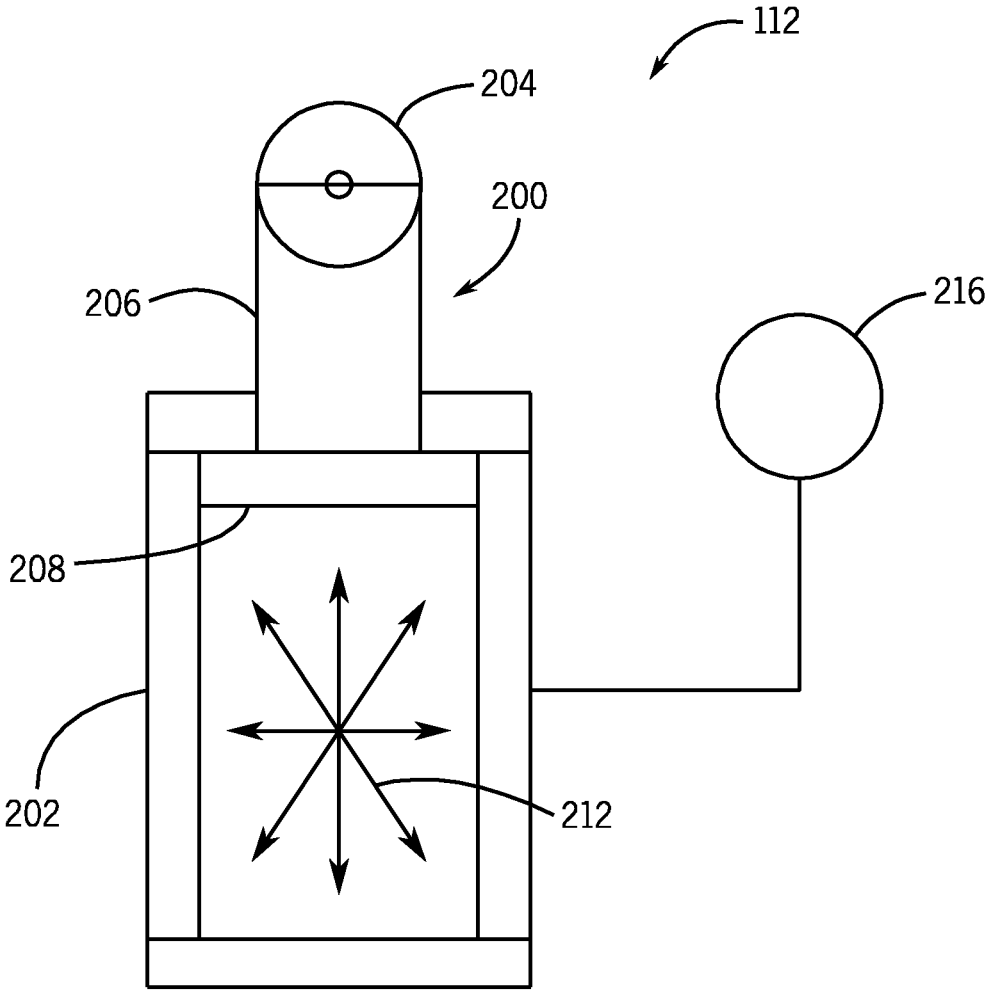
FIG. 4 is a schematic side view of an air roller of the tubular coupling feature illustrated in FIGS. 2 and 3 in accordance with present techniques.

FIG. 4 illustrates a resilient roller assembly 112 in accordance with present embodiments. As set forth above, present embodiments may include numerous (e.g., 15) resilient roller assemblies 112. The resilient roller assembly 112 includes a piston 200, a cylinder 202, and a roller 204. The piston 200 includes a shaft 206 and a crown 208. The roller 204, which can include a cylindrical roller or a ball bearing, is positioned on a distal end of the shaft 206 opposite the crown 208. Thus, the roller 204 is capable of engaging a tubular surface or the like (e.g., a outer diameter, a tool joint lip, or a bushing coupled with tubular). The piston 200 is configured to vertically move into and out of the cylinder 202. In the illustrated embodiment, the piston 200 is configured to slide relative to a vertical axis of the gripping device 60 to compensate for force applied by the tubular element. The crown 208 creates a movable seal within the cylinder 202 to establish resiliency of the assembly 112. Indeed, the cylinder 202 is pressure-controlled, as represented by arrows 212, such that the piston 200 can be pressed into the cylinder 202 when force is applied by tubular and then return to a default position when the force of the tubular is removed. In accordance with present embodiments, this offsetting of the force applied by the tubular via resiliency of the roller assembly 112 is employed to avoid or limit damage to tubular when stabbing into a stump or making up tubular threads. In one embodiment, the resilient roller assembly 112 includes a gas-operated piston mechanism configured to maintain a level of gas pressure therein. For example, in one embodiment, the resilient roller assembly 112 includes a pressure controller 216 configured to generally maintain a pressure (e.g., 125 psi) within the cylinder 202.

Figure 5:
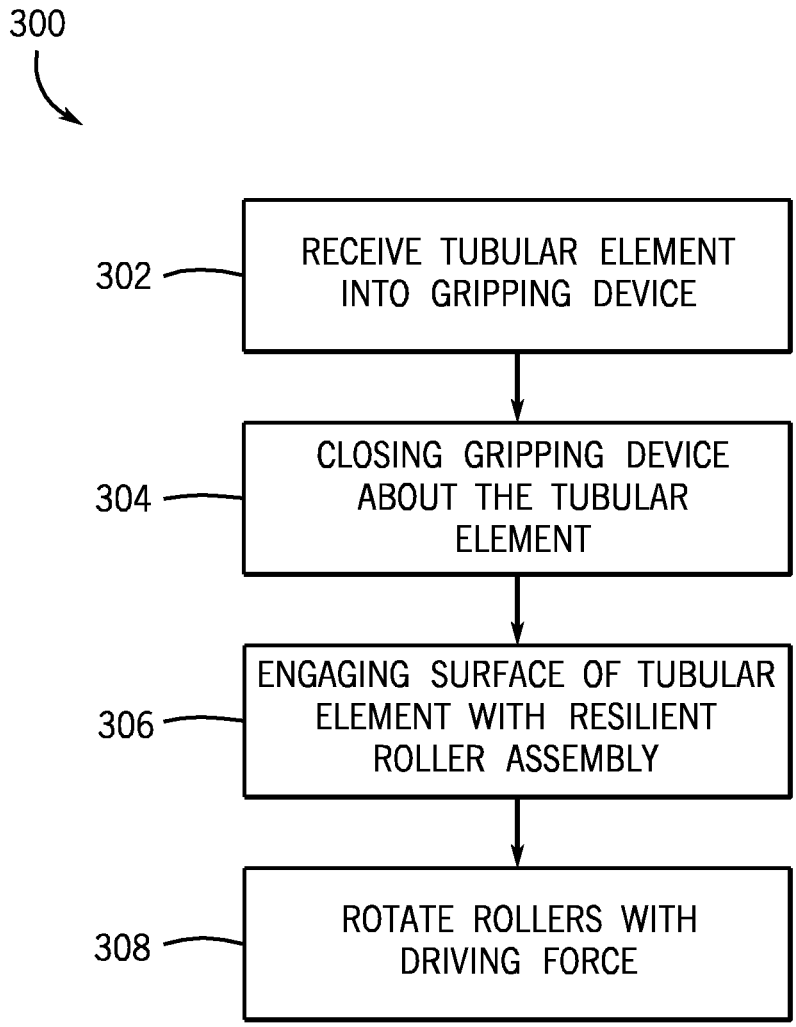
FIG. 5 is a process flow diagram of a method in accordance with present techniques.

FIG. 5 is a flow diagram of a method for assembling tubular elements in accordance with present embodiments. The method is generally indicated by reference numeral 300. The method 300 begins with receiving a tubular element into a gripping device, as represented by block 302, wherein receiving the tubular includes the tubular being positioned between at least two body components of the gripping device. Next, the method 300 includes closing the gripping device about the tubular element, as represented by block 304. This may include moving at least one engagement arm attached to the gripping device such that one end of the engagement arm is repositioned away from a rig bail to which the engagement arm is coupled and such that the first portion of the gripping device, which is also coupled to the engagement arm, engages with the second portion of the engagement device about the tubular element. The method 300 also includes engaging a surface of the tubular element with rollers of a plurality of roller assemblies integrated with or coupled to the gripping device such that the roller assemblies adjust for force applied by the tubular element, as represented by block 306. In the illustrated embodiment, the method 300 also includes providing rotational force to the tubular element about an axis of the tubular element via the roller assemblies by driving rotation of the rollers with a motor, as represented by block 308.

While only certain features of the invention have been illustrated and described herein, many modifications and changes will occur to those skilled in the art. It is, therefore, to be understood that the appended claims are intended to cover all such modifications and changes as fall within the true spirit of the invention.

The invention claimed is:

1. A stand compensator system, comprising:

a gripping device configured to engage a tubular element by coupling about an outer circumference of the tubular element;

a plurality of resilient roller assemblies positioned proximate an inner perimeter of the gripping device, wherein the resilient roller assemblies include rollers arranged to engage with an abutting surface of the tubular element; and engagement arms coupled with the gripping device, wherein the engagement arms are configured to hold the gripping device in position in axial alignment with and above a tubular elevator and wherein the engagement arms are configured to couple to rig bails extending from the tubular elevator and hold the gripping device between the rig bails, wherein the engagement arms are configured to extend and retract with engagement and disengagement of the gripping device.

2. The system of claim 1, wherein the rollers comprise balls or cylindrical rollers extending from an upper surface of the gripping device and arranged to engage a lip of a tool joint of the tubular element or a bushing coupled to the tubular element.

3. The system of claim 1, wherein the rollers comprise balls or cylindrical rollers extending into the inner perimeter of the gripping device and arranged to engage with the outer circumference of the tubular element.

4. The system of claim 1, wherein the plurality of resilient rollers include pistons coupled to the rollers, wherein the pistons are configured to slide relative to a vertical axis of the gripping device to compensate for force applied by the tubular element.

5. The system of claim 1, wherein the plurality of resilient rollers include a gas-operated piston mechanism configured to maintain a level of gas pressure within the gas-operated piston mechanism.

6. A stand compensator system, comprising:

a gripping device configured to engage a tubular element by coupling about an outer circumference of the tubular element;

a plurality of resilient roller assemblies positioned proximate an inner perimeter of the gripping device, wherein the resilient roller assemblies include rollers arranged to engage with an abutting surface of the tubular element;

engagement arms coupled with the gripping device, wherein the engagement arms are configured to hold the gripping device in position in axial alignment with and above a tubular elevator and wherein the engagement arms are configured to couple to rig bails extending from the tubular elevator and hold the gripping device between the rig bails; and a motor configured to drive one or more of the rollers such that each driven roller spins about its own axis in a clockwise or counterclockwise direction.

7. The system of claim 1, comprising resilient features configured to adjust based on force applied by the tubular element via the gripping device.

8. A stand compensator system, comprising:

a tubular elevator and rig bails;

a gripping device configured to engage the tubular element by coupling about an outer circumference of the tubular element;

a plurality of resilient roller assemblies positioned proximate an inner perimeter of the gripping device, wherein the resilient roller assemblies include rollers arranged to engage with an abutting surface of the tubular element; and engagement arms coupled with the gripping device, wherein the engagement arms are configured to hold the gripping device in position in axial alignment with and above a tubular elevator and wherein the engagement arms are configured to couple to the rig bails extending from the tubular elevator and hold the gripping device between the rig bails, wherein actuator arms couple the engagement arms with the rig bails.

9. A stand compensator system, comprising:

a gripping device configured to engage a tubular element by coupling about an outer circumference of the tubular element;

a plurality of resilient roller assemblies positioned proximate an inner perimeter of the gripping device, wherein the resilient roller assemblies include rollers arranged to engage with an abutting surface of the tubular element;

engagement arms coupled with the gripping device, wherein the engagement arms are configured to hold the gripping device in position in axial alignment with and above a tubular elevator and wherein the engagement arms are configured to couple to rig bails extending from the tubular elevator and hold the gripping device between the rig bails; and at least one actuator arm coupled to at least one of the rig bails and configured to move the gripping device into position about the tubular element.

10. The system of claim 9, wherein the at least one actuator arm comprises a hydraulic piston coupled to an upper portion of one of the engagement arms, and wherein the one of the engagement arms is hingedly coupled to at least one of the rig bails at a lower portion of the one of the engagement arms.

11. A stand compensator system, comprising:

a tubular elevator;

a first rig bail and a second rig bail, wherein each of the first and second rig bails is coupled to the tubular elevator and extends upward from the tubular elevator;

a gripping device positioned between the first rig bail and the second rig bail, wherein the gripping device is configured to engage a tubular element by coupling about an outer circumference of the tubular element and wherein the gripping device comprises a plurality of resilient roller assemblies positioned proximate an inner perimeter of the gripping device, wherein the resilient roller assemblies include rollers arranged to engage with an abutting surface of the tubular element;

a first engagement arm coupled to the first rig bail and coupled to the gripping device;

a second engagement arm coupled to the second rig bail and coupled to the gripping device; and a first actuator configured to reposition the first engagement arm, wherein the resilient roller assemblies include a chamber, a rod with a seal positioned at least partially within the chamber, an axis coupled proximate a distal end of the rod, and the rollers coupled to the axis and configured to rotate about the axis.

12. The system of claim 11, wherein the resilient roller assemblies include air rollers that provide resiliency via integral pistons configured to maintain a level of internal air pressure.

13. The system of claim 11, wherein the rollers include balls, cylindrical rollers, or both.

14. A method for assembling tubular elements, comprising:

receiving a tubular element into a gripping device, wherein the gripping device includes a first portion and a second portion;

closing the gripping device about the tubular element by moving at least one engagement arm such that one end of the engagement arm is repositioned away from a rig bail to which the engagement arm is coupled and such that the first portion of the gripping device, which is also coupled to the engagement arm engages with the second portion of the engagement device about the tubular element;

engaging a surface of the tubular element with rollers of a plurality of roller assemblies integrated with the gripping device; and facilitating attachment of the tubular element to another tubular element.

15. The method of claim 14, comprising providing rotational force to the tubular element about an axis of the tubular element via the roller assemblies by driving rotation of the rollers with a motor.

16. The method of claim 14, comprising adjusting positioning of components of the roller assemblies based on vertical force applied to the roller assemblies by the tubular element.

17. The method of claim 14, comprising driving an actuation arm coupled to the engagement arm and the rig bail to move the at least one engagement arm.

18. The method of claim 14, comprising engaging an outer cirmcumfercial surface of the tubular element, a lip of a tool joint of the tubular element, or both with the rollers.

19. A stand compensator system, comprising:

a gripping device configured to engage a tubular element by coupling about an outer circumference of the tubular element;

a plurality of resilient roller assemblies positioned proximate an inner perimeter of the gripping device, wherein the resilient roller assemblies include rollers arranged to engage with an abutting surface of the tubular element;

engagement arms coupled with the gripping device, wherein the engagement arms are configured to hold the gripping device in position above a tubular elevator and couple between rig bails extending from the tubular elevator; and at least one actuator arm coupled to at least one of the rig bails and configured to move the gripping device into position about a tubular element, wherein the at least one actuator arm comprises a hydraulic piston coupled to an upper portion of one of the engagement arms, and wherein the one of the engagement arms is hingedly coupled to at least one of the rig bails at a lower portion of the one of the engagement arms.

* * * * *